US006397925B1

(12) United States Patent
Saito et al.

(10) Patent No.: US 6,397,925 B1
(45) Date of Patent: Jun. 4, 2002

(54) AGITATED CONTINUOUS CASTING APPARATUS

(75) Inventors: Nobuhiro Saito, Wako; Takashi Idegomori, Sayama; Teruyuki Ohtani; Takeyoshi Nakamura, both of Wako; Kiyonobu Mizoue, Sayama, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/257,247

(22) Filed: Feb. 25, 1999

(30) Foreign Application Priority Data

Mar. 5, 1998 (JP) ..... 10-053450
Jun. 12, 1998 (JP) ..... 10-165600

(51) Int. Cl.[7] ..... B22D 27/02; B22D 11/049
(52) U.S. Cl. ..... 164/504; 164/444; 164/487
(58) Field of Search ..... 164/468, 504, 164/487, 444

(56) References Cited

U.S. PATENT DOCUMENTS 4,214,624 A * 7/1980 Foye et al. ..... 164/487
5,219,018 A * 6/1993 Meyer ..... 164/900

FOREIGN PATENT DOCUMENTS

DE 30 06 588 9/1980
DE 30 06 618 9/1980
DE 34 24 457 1/1986
EP 0 063 757 11/1982
EP 0 439 981 8/1991

* cited by examiner

*Primary Examiner*—Kuang Y. Lin
(74) *Attorney, Agent, or Firm*—Arent Fox Kintner Plotkin & Kahn PLLC.

(57) ABSTRACT

An agitated continuous casting apparatus includes a spout having an upward-turned molten metal receiving port and a downward-turned molten metal outlet, a cylindrical water-cooled casting mold disposed immediately below the spout, and an agitator for applying an electromagnetic agitating force to the molten metal in the spout. The agitator has a function to form, in the spout, an upper area for moving the molten metal in a substantially radiate direction, and a lower area for rotating the molten metal in a circumferential direction. An upper area forming portion of an inner peripheral surface of the spout is formed into a tapered shape with its inside diameter gradually increased from its upper peripheral edge toward its lower peripheral edge. Thus, the molten metal moved in the substantially radiate direction to collide against the upper area forming portion can be moved toward the lower area, and crystallized products having a higher melting point in the molten metal can be spheroidized and collected into an outer periphery of a continuous casting material, and a shape retention effect of the crystallized products can be utilized. Therefore, the continuous casting material has a good rheologic property and an excellent shape maintaining property in its semi-molten state.

7 Claims, 17 Drawing Sheets

AGITATED CONTINUOUS CASTING APPARATUS

BACKGROUND OF THE INVENTION

1. Field of the Invention

The present invention relates to an agitated continuous casting apparatus.

2. Description of the Related Art

There is a conventionally known agitated continuous casting apparatus including a spout having an upward-turned molten metal receiving port and a downward-turned molten metal outlet, a cylindrical water-cooled casting mold disposed immediately below the spout to cool a molten metal from the molten metal outlet, and an agitator for applying an electromagnetic agitating force to the molten metal in the spout.

A continuous casting material is used, for example, as a thixocasting material. In carrying out a thixocasting process, a procedure is employed which comprises subjecting a casting material to a heating treatment to prepare a semi-molten casting material having solid and liquid phases coexisting therein; transferring the semi-molten casting material to a pressurizing-type casting machine; and thereafter charging the semi-molten casting material into a cavity of a casting mold under pressurization. In this case, such a measure is employed, for example, that a substantially short columnar casting material is used, and in the heating treatment, the short columnar casting material is placed in a raised state into a high-frequency coil, and at the transferring step, an outer periphery of the semi-molten casting material is grasped by a clamping member.

For this purpose, it is required that the thixocasting material show a uniform softening property in its entirety at a relatively low temperature, namely, has a good rheologic property and an excellent shape-maintaining property in its semi-molten state.

The spout in the known apparatus has an inside radius $r_1$ which is uniform over its entire length, and the water-cooled casting mold has an inside radius $r_2$ set, e.g., in a range of $r_2 \geqq r_1+20$ mm. This is because if $r_2<r_1+20$ mm, a difference between the temperatures of an upper portion of the water-cooled casting mold and a lower portion of the spout close to the upper portion is small. For this reason, even if the molten metal is brought into contact with the water-cooled casting mold, it is not solidified and as a result, a large number of crystallized products having a high melting point in the molten metal flows back toward the molten metal inlet along the inner peripheral surface of the spout due to their viscosity, making it not possible, to carry out the casting.

However, if the relationship between both the inside radii $r_1$ and $r_2$ is set in the range of $r_2 \geqq r_1+20$ mm, as described above, a large difference is produced between the temperatures of the upper portion of the water-cooled casting mold and the lower portion of the spout close to the upper portion. For this reason, the molten metal is liable to be quenched by the water-cooled casting mold to produce dendrite in the outer periphery of a continuous casting material. Such a material suffers from a problem that while it has a good shape-maintaining property in its semi-molten state due to the presence of the dendrite, the softening property of the outer periphery is degraded, resulting in a poor rheologic property.

There is also a conventionally known agitated continuous casting apparatus of the above-described type, which includes a cylindrical water-cooled casting mold having a vertically turned axis and a plurality of cooling water ejecting bores provided through a lower portion of a peripheral wall of the casting mold, and a cylindrical partition wall surrounding the cylindrical water-cooled casting mold to define a cooling water sump around an outer periphery of the cylindrical water-cooled casting mold, and an agitator for applying an agitating force to a molten metal in the cylindrical water-cooled casting mold for causing the molten metal to flow in a circumferential direction.

The vibration due to the agitating force is generated in the cylindrical water-cooled casting mold. When this vibration is not suppressed sufficiently, there is a possibility of a phenomenon bringing about that an unsolidified portion in an ingot breaks through a solidified portion in an outer periphery of the ingot, namely, a situation that a break-out is generated to make the casting impossible. In order to avoid such situation, a measure to strengthen the cylindrical water-cooled casting mold and its support structure is commonly employed.

However, if such a measurers employed, the following new problem is encountered: the cylindrical water-cooled casting mold and its support structure are increased in size and complicated, and this in turn causes an increase in size of the entire apparatus and an increase in manufacture cost.

SUMMARY OF THE INVENTION

Accordingly, it is an object of the present invention to provide an agitated continuous casting apparatus of the above-described type, wherein a continuous casting material having a good rheologic property and an excellent shape maintaining property in its semi-molten state can be obtained.

To achieve the above object, according to a first aspect and feature of the present invention, there is provided an agitated continuous casting apparatus comprising a spout having an upward-turned molten metal receiving port and a downward-turned molten metal outlet, a cylindrical water-cooled casting mold disposed immediately below the spout to cool a molten metal from the molten metal outlet, and an agitator for applying an electromagnetic agitating force to the molten metal in the spout so as to rotate the molten metal in a circumferential direction, wherein the agitator cooperates with the spout to form, in the spout, an upper area for permitting the molten metal to move in a substantially radiate direction while permitting it to rotate in the circumferential direction, and a lower area for permitting the molten metal to rotate in the circumferential direction, the spout having an upper area forming portion at an inner peripheral surface thereof, the upper area forming portion being formed into a tapered shape with an inside diameter thereof gradually increasing from its upper peripheral edge toward its lower peripheral edge in order to move, toward the lower area, the molten metal that is in the substantially radiate direction and collided against the upper area forming portion at the inner peripheral surface of the spout.

In the upper area, a large number of crystallized products having a high melting point are produced. The large number of crystallized products in the molten metal moved from the upper area to the lower area are spheroidized in the lower area under an agitating action rotating in the circumferential direction, and are moved in a large amount toward the outer periphery side by a centrifugal force. Thereafter, the molten metal is cooled by the water-cooled casting mold. During this time, the movement of the crystallized products of the high-melting point from the upper area to the lower area is being conducted ceaselessly and hence, the back flow of the crystallized products of the high-melting point from the lower area to the upper area is not produced.

In the continuous casting material produced in the above manner, the large number of the crystallized products of the high-melting point existing in the outer periphery have been spheroidized and hence, the outer periphery shows a softening property similar to that of the main portion excluding the outer periphery. Therefore, the continuous casting material has a good rheologic property. Because the large number of the crystallized products of the high-melting point exist in the outer periphery, the continuous casting material exhibits an excellent shape-maintaining property in its semi-molten state by a shape retention effect provided by the crystallized products of the higher-melting point.

It is another object of the present invention to provide an agitated continuous casting apparatus of the above-described type, wherein the vibration of the cylindrical water-cooled casting mold due to the agitating force can be suppressed by a simple measure.

To achieve the above object, according to a second aspect and feature of the present invention, there is provided an agitated continuous casting apparatus comprising a cylindrical water-cooled casting mold having a vertically turned axis and a plurality of cooling water ejecting bores provided through a lower portion of a peripheral wall of the casting mold, a cylindrical partition wall surrounding the casting mold to define a cooling water sump around an outer periphery of the cylindrical water-cooled casting mold, and an agitator for applying an agitating force to a molten metal in the cylindrical water-cooled casting mold for causing the molten metal to flow in a circumferential direction, wherein a rubber-like elastomeric member having an impact resilience R in a range of $10\% \leqq R \leqq 40\%$ is interposed between the cylindrical water-cooled casting mold and the cylindrical partition wall.

The rubber-like elastomeric member is defined to include an elastomeric member formed of a rubber, an elastomeric member formed of a plastic, and the like. The impact resilience R is determined according to an equation, $R=(H_1/H_0)\times 100$ (%), wherein $H_1$ represents a height to which a sphere of a constant load is bounded up when the sphere is dropped freely onto the surface of the rubber-like elastomeric member.

The rubber-like elastomeric member having the impact resilience R defined as described above suppresses the vibration of the cylindrical water-cooled casting mold due to the agitating force. Thus, the generation of a break-out can be prevented to advance the casting operation smoothly.

If a solidified product has been deposited on an inner surface of the cylindrical water-cooled casting mold, the rubber-like elastomeric member permits a partial deformation of the cylindrical water-cooled casting mold in a radially outward direction based on the impact resilience, when the molten metal flowing under the action of the electromagnetic agitating force collides against the solidified product. This causes the speed of the cooling water ejected from the ejection bore by compression of the cooling water sump to be increased, thereby increasing the flow rate. Therefore, the cooling of the ingot is conducted rapidly and hence, the molten metal in the vicinity of the solidified product is also solidified or brought into a semi-molten state. Therefore, the solidified product is taken into the ingot being dropped and is thus peeled off from the inner surface of the cylindrical water-cooled casting mold. In a state in which the solidified product has been deposited on the inner surface of the mold, a recessed trace is formed on the outer peripheral surface of the ingot to produce a casting defect.

If the impact resilience R of the rubber-like elastomeric member is in a range of $R>40\%$, the vibration suppressing effect is obtained to reduce the generation of break-out, because the rubber-like elastomeric member shows the resilience substantially similar to that of a metal member, but the recessed trace is liable to be produced, because the deformation permitting effect is not obtained. On the other hand, if $R<10\%$, substantially the same state is achieved as in a case where the rubber-like elastomeric member is not interposed between the cylindrical water-cooled casting mold and the cylindrical partition wall. For this reason, the generation of the break-out is increased, and the deformation permitting effect is excessive, whereby the flow of cooling water is damped up and hence, the recessed trace is liable to be produced.

The above and other objects, features and advantages of the invention will become apparent from the following description of the preferred embodiment taken in conjunction with the accompanying drawings.

DETAILED DESCRIPTION OF THE PREFERRED EMBODIMENTS

[Example I (FIGS. 1 to 14)]

Figure 1:
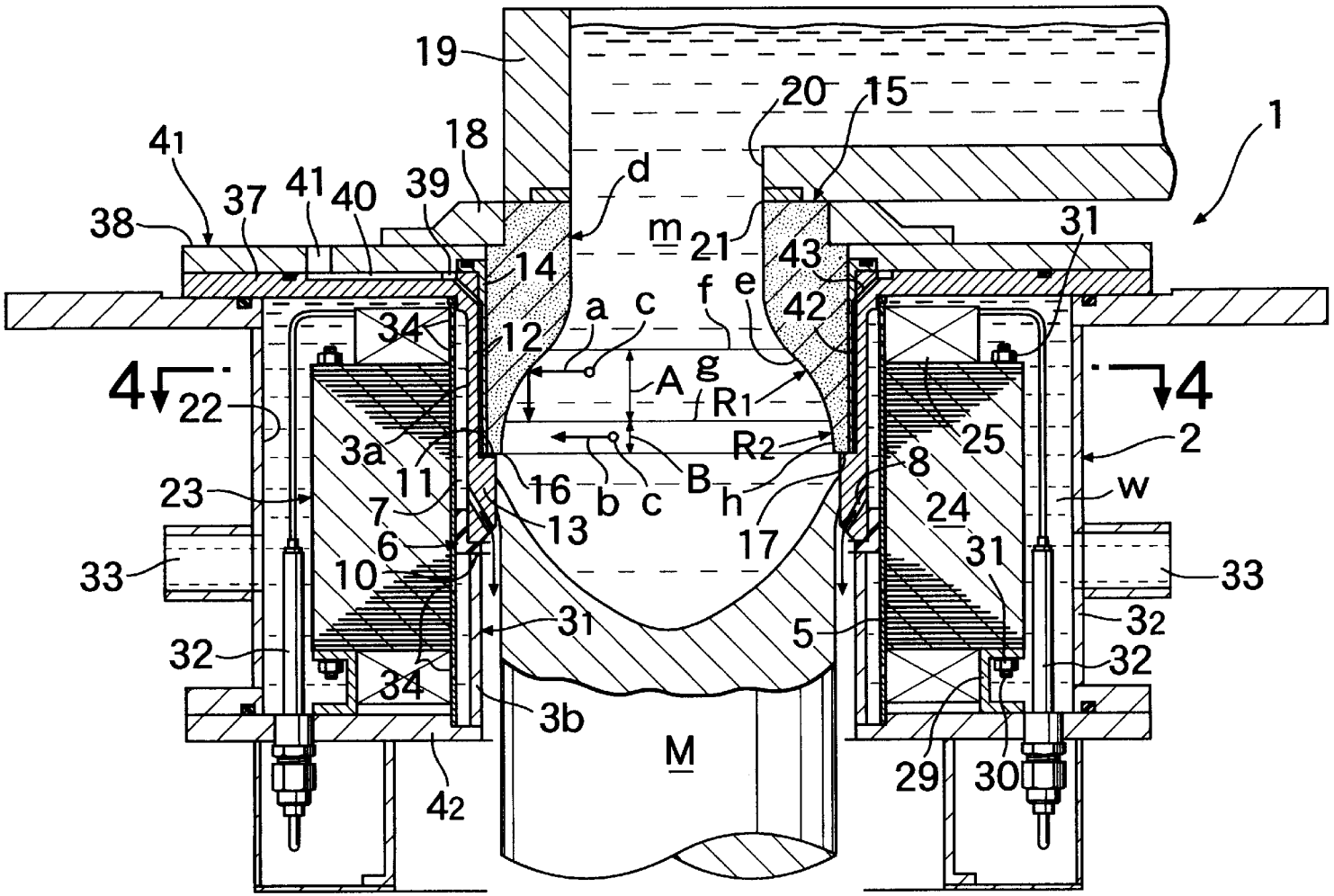
FIG. 1 is a vertical sectional view of an agitated continuous casting apparatus according to a first embodiment of the present invention.
Figure 2:
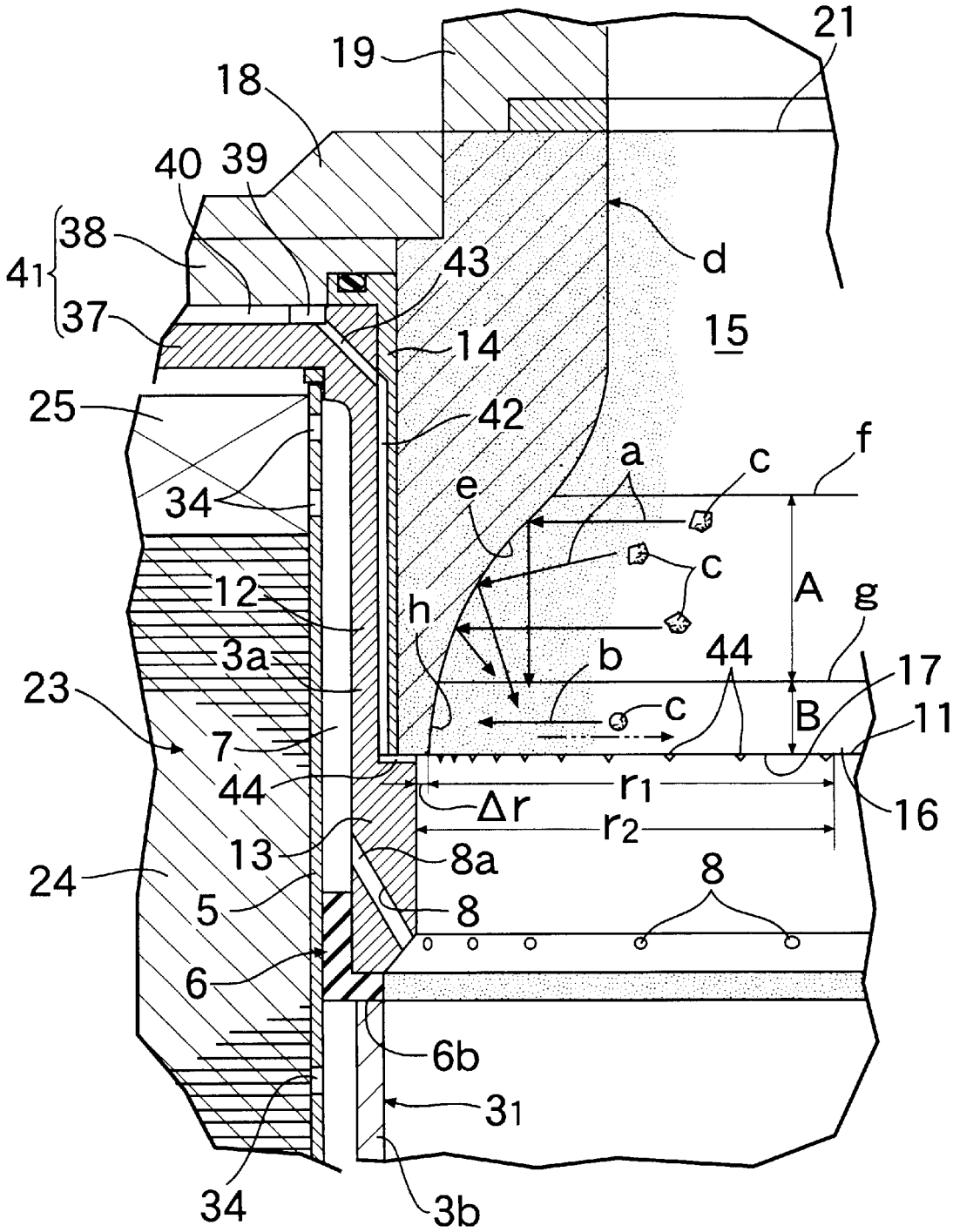
FIG. 2 is an enlarged view of an essential portion of the agitated continuous casting apparatus shown in FIG. 1.

An agitated continuous casting apparatus 1 shown in FIGS. 1 and 2 includes a drum-shaped body 2 having an axis turned vertically. The drum-shaped body 2 is comprised of an inner peripheral wall $\mathbf{3}_1$, an outer peripheral wall $\mathbf{3}_2$ disposed at a predetermined distance around the outer periphery of the inner peripheral wall $\mathbf{3}_1$, an annular upper end wall $\mathbf{4}_1$ located at upper ends of both the walls $\mathbf{3}_1$ and $\mathbf{3}_2$, and an annular lower end wall $\mathbf{4}_2$ located at lower ends of both the walls $\mathbf{3}_1$ and $\mathbf{3}_2$.

The inner peripheral wall $\mathbf{3}_1$ comprises an upper cylindrical portion 3*a* and a lower cylindrical portion 3*b*. Lower half of the upper cylindrical portion 3*a* is formed at a thickness larger than that of upper half 12, so that an annular step 11 is formed inside the lower half, thereby forming a cylindrical water-cooled casting mold 13. The cylindrical water-cooled casting mold 13 is formed of an aluminum alloy (e.g., A5052) and has a plurality of cooling water ejection bores 8 provided through a lower portion of its peripheral wall. The ejection bores 8 are defined to extend obliquely downwards, so that they converge at one point on an axis of the cylindrical water-cooled casting mold 13.

A cylindrical partition wall 5 is disposed to surround the inner peripheral wall $\mathbf{3}_1$ and has upper and lower openings closed by the upper and lower end walls $\mathbf{4}_1$ and $\mathbf{4}_2$, respectively. A rubber-like elastomeric member 6 is interposed between the cylindrical water-cooled casting mold 13 and the cylindrical partition wall 5. The rubber-like elastomeric member 6 is an annular member fitted in the cylindrical water-cooled casting mold 13 below an inlet 8*a* of each ejection bore 8. An annular portion 6*b* at an end of an inner peripheral surface of the elastomeric member 6 is clamped between a lower end face of the cylindrical water-cooled casting mold 13 and an upper end face of the lower cylindrical portion 3*b* to seal them from each other. A cooling water sump 7 is defined around an outer periphery of the cylindrical water-cooled casting mold 13 by the cylindrical partition wall 5 and the rubber-like elastomeric member 6.

A spout 15 is fitted into the upper half 12 with a thin cylindrical member 14 interposed therebetween, so that it is located coaxially with the cylindrical water-cooled casting mold 13. An annular lower end face 17 of the spout 15 forming a downward-turned molten metal outlet 16 abuts against the annular step 11. An annular removal-preventing plate 18 is fitted over that portion of the spout 15 which protrudes from the upper end wall $\mathbf{4}_1$. The annular removal-preventing plate 18 is fixed to the upper end wall 4. The spout 15 is formed of calcium silicate having a heat-insulating property and a fire resistance. Alternatively, alumina, silica or the like may be used as a material for forming the spout 15. A molten metal supply tub 19 for pouring a molten metal horizontally is disposed above the spout 15 and has a downward-turned molten metal supply 20 communicating with an upward-turned molten metal receiving port 21 of the spout 15.

Figure 3:
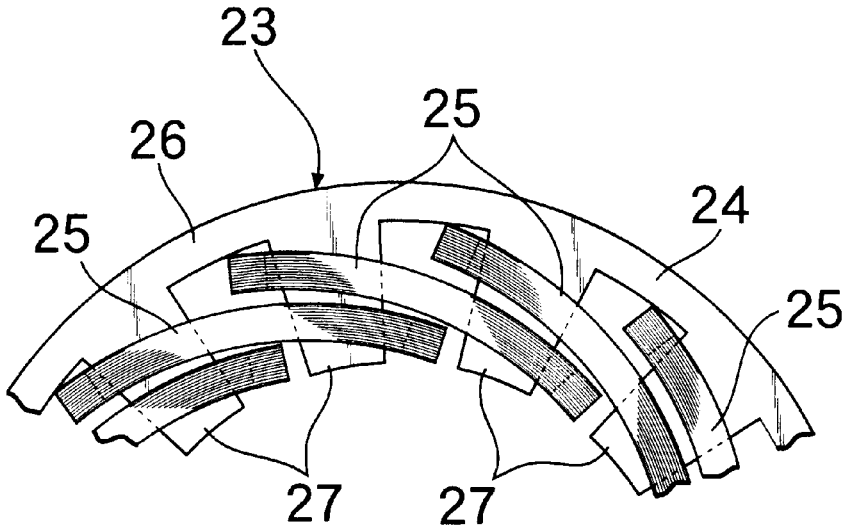
FIG. 3 is a plan view of an essential portion showing the relationship between a stratified iron core and a coil.

An electromagnetic induction-type agitator 23 is disposed in a cylindrical closed space 22 between the cylindrical partition wall 5 and the outer peripheral wall $\mathbf{3}_2$. The agitator 23 provides an electromagnetic agitating force to a molten metal m present within the cylindrical water-cooled casting mold 13 and the spout 15 for permitting the molten metal to flow circumferentially. The agitator 23 comprises a cylindrical stratified iron core 24, and a plurality of coils 25 wound around the cylindrical stratified iron core 24. The stratified iron core 24 is comprised of a cylindrical portion 26, and a plurality of projections 27 disposed circumferentially at equal distances on an inner peripheral surface of the cylindrical portion 26 to extend in a direction of a generating line, as best shown in FIG. 3. Each of the coils 25 is wound around the adjacent projections 27, so that portions of two coils 25 overlap each other on one projection 27, and a tip end face of each projection 27 is in close contact with the peripheral surface of the cylindrical partition wall 5. The stratified iron core 24 is placed on an annular support member 29 on the lower end wall $\mathbf{4}_2$ and fixed to the member 29 by a plurality of bolts 30 and nuts 31. A plurality of connectors 32 are provided two for one coil 25 and mounted through the lower end wall $\mathbf{4}_2$ by a water-tight means.

A plurality of water supply ports 33 are defined in the outer peripheral wall $\mathbf{3}_2$, so that cooling water w is supplied through the water supply ports 33 into the closed space 22. A plurality of through-bores 34 are defined in the vicinity of an upper end of the cylindrical partition wall 5, so that the cooling water w is supplied through the through-bores 34 into the cooling water sump 7. The cooling water w cools the cylindrical water-cooled casting mold 13, and is ejected from the ejection bores 8 to cool an ingot I. Through-bores 34 are also defined in a lower portion of the cylindrical partition wall 5.

In order to supply a lubricating oil to between the water-cooled casting mold 13 and the molten metal m, a lubricating oil passage is provided around the spout 15. A lower plate 37 of the upper end wall $\mathbf{4}_1$ is integrally provided on an upper end of the upper cylindrical portion 3*a* of the inner peripheral wall $\mathbf{3}_1$. Provided between an upper plate 38 and the lower plate 37 of the upper end wall $\mathbf{4}_1$ are an annular passage 39 surrounding the spout 15, and a plurality of straight passages 40 extending radiately from the annular passage 39. An inlet 41 defined in the upper plate 38 communicates with ends of the straight passages 40, and is connected to an oil supply pump. As best shown in FIG. 2, a cylindrical passage 42 is defined between an inner peripheral surface of the upper half 12 of the upper cylindrical portion 3*a* and an outer peripheral surface of the cylindrical member 14, and a plurality of obliquely-turned through bores 43 are defined in a connection between the upper half 12 and the lower plate 37 to permit the communication between the cylindrical passage 42 and the annular passage 39. A lower end of the cylindrical passage 42 communicates with a plurality of V-shaped outlets 44 arranged radiately between the annular step 11 and the annular lower end face 17 of the spout 15.

In the above-described arrangement, when the molten metal m comprising, for example, an aluminum alloy is supplied from the molten metal supply port 20 of the molten metal supply tub 19 into the spout 15, an electromagnetic agitating force is applied to the molten metal m in the spout 15 by the agitator 23, and the molten metal m is then cooled by the water-cooled casting mold 13 to provide an ingot, namely, a continuous casting material M.

Figure 4:
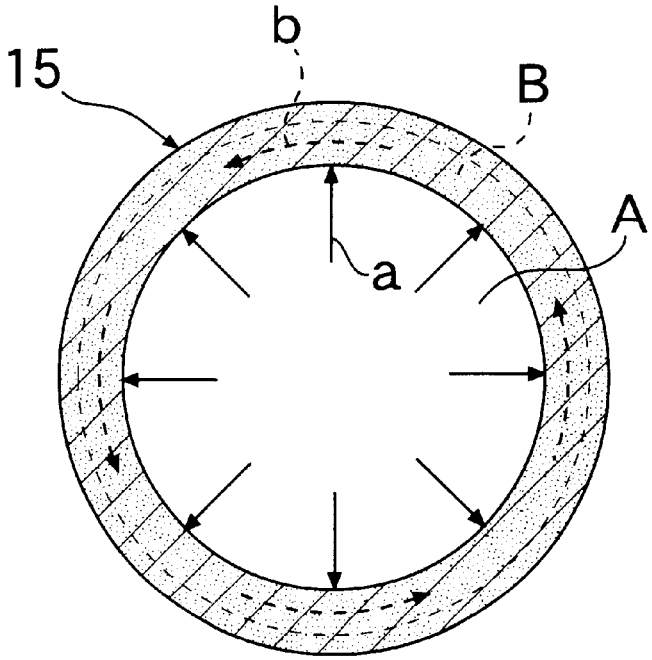
FIG. 4 is a sectional view of a spout, taken along a line 4—4 in FIG. 1.

The agitated continuous casting apparatus 1 is provided with a unique structure which will be described below. The electromagnetic induction-type agitator 23 has a function to form an upper area A for permitting the molten metal m to move in a substantially radiate direction a in a vertically intermediate portion of the spout 15 while permitting it to rotate circumferentially, and a lower area B for permitting the molten metal m to rotate circumferentially in a lower portion of the spout 15, as best shown in FIGS. 1, 2 and 4. An upper area forming portion e of the inner peripheral surface d of the spout is of such a tapered shape that the inside diameter is gradually increased from its upper peripheral edge f toward its lower peripheral edge g thus causing the molten metal to move in the substantially radiate direction. A lower area forming portion h of the inner peripheral surface d of the spout is also of such a tapered shape that the inside diameter is gradually increased from the upper peripheral edge f of the upper area forming portion e which is an upper peripheral edge of the lower area forming portion h toward the molten metal outlet 16 which is a lower peripheral edge of the lower area forming portion h. In the illustrated embodiment, the upper and lower area forming portions e and h of the inner peripheral surface d of the spout are curved faces, and a relation, $R_1<R_2$ is established between the radius $R_1$ of curvature of the upper area forming portion e and the radius $R_2$ of curvature of the lower area forming portion h.

In order to reliably prevent the crystallization of dendrite in the outer periphery of the continuous casting material M, a means which will be described below is employed. If the inside radius of the molten metal outlet 16 of the spout 15 is represent ed by $r_1$, and the inside radius of the water-cooled casting mold 13 is represented by $r_2$, relations, $r_1<r_2$ and $r_2-r_1=\Delta r$ (wherein $\Delta r$ is an amount of protrusion of the spout 15) between the inside radii $r_1$ and $r_2$. The amount $\Delta r$ of protrusion assumes a maximum value of the distance required to avoid the crystallization of dendrite, when the molten metal m from the molten metal outlet 16 is brought into contact with the inner peripheral surface of the water-cooled casting mold 13.

In the above-described arrangement, the molten metal m moved in the substantially radiate direction a to collide against the upper area forming portion e of the inner peripheral surface d of the spout is displaced toward the lower area B. In this case, a large number of crystallized products c having a high melting point are produced in the upper area A. The large number of crystallized products c moved from the upper area A to the lower area B are spheroidized under an agitating action rotating in a circumferential direction b in the lower area B and moved in a large amount toward the outer periphery by a centrifugal force. In this case, when the relation between the curvature radii $R_1$ and $R_2$ is $R_2<R_1$, there is a possibility that the lower area B is narrowed, resulting in an insufficient agitating action. Thereafter, the molten metal m is cooled by the water-cooled casting mold 13. During this time, the forcible movement of the crystallized products c of the high melting point from the upper area A to the lower area B is conducted unceasingly and hence, any back flow of the crystallized products c of the high melting point from the lower area B to the upper area A is not produced.

Figure 5:
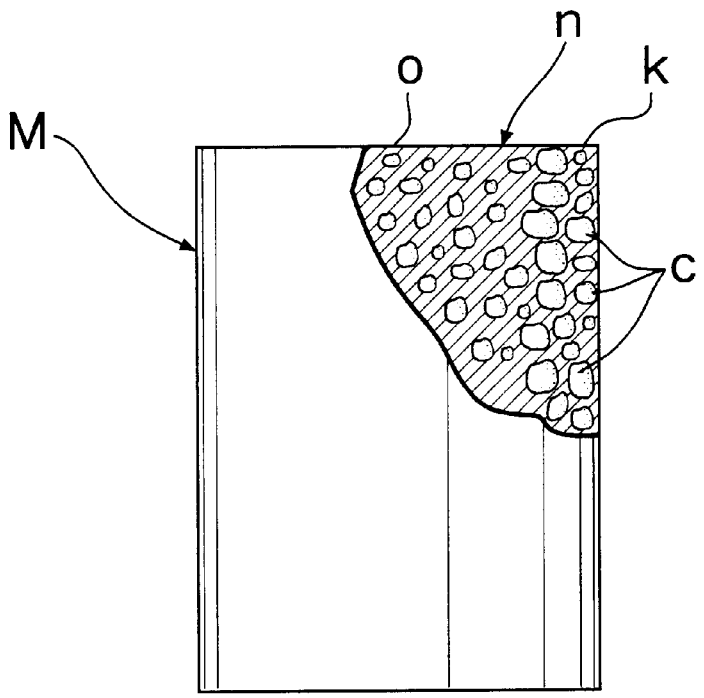
FIG. 5 is a cutaway front view of an essential portion of a continuous casting material.

As shown in FIG. 5, the large number of the crystallized products c of the high melting point existing in an outer periphery k of the continuous casting material M produced in the apparatus 1 are spheroidized, and the outer periphery k contains no dendrite and hence, shows a softening property similar to that of a main portion n excluding the outer periphery k. Therefore, the continuous casting material M has a good rheologic property. Because the large number of the crystallized products c of the high melting point exist in the outer periphery k, the continuous casting material M exhibits an excellent shape maintaining property in its semi-molten state by virtue of a shape retention effect provided by the crystallized products c of the high melting point.

An example of production of a continuous casting material by the apparatus 1 of the present embodiment and an apparatus of an comparative example will be described below.

[First Example of Production]

Table 1 shows the composition of an aluminum alloy which is a starting material. The aluminum alloy includes a eutectic component.

TABLE 1

| Chemical constituent (% by weight) | | | | | | | | | | |
|---|---|---|---|---|---|---|---|---|---|---|
| Cu | Si | Mg | Zn | Fe | Mn | Ni | Cr | Ti | Sr | Al |
| 4.7 | 7.5 | 0.26 | 0.47 | 0.77 | 0.48 | 0.07 | 0.1 | 0.13 | 0.02 | balance |

Conditions of the casting carried out in the apparatus 1 of the present embodiment are as follows.

(1) The inside radius $r_2$ of the water-cooled casting mold 13 was 77.3 mm; and the shape of the spout 15 was such that the radius $R_1$ of curvature of the upper area forming portion e is equal to 60 mm, and the radius $R_2$ of curvature of the lower area forming portion h was equal to 70 mm; and the inside radius $r_1$ of the molten metal outlet 16 was changed to vary the amount $\Delta r$ of protrusion of the spout 15. The spout 15 is referred to as a different-diameter bored spout.

(2) The casting rate: 170 mm/min; the lubricating oil: PTFE particle-added mineral oil; the amount of lubricating oil supplied: 1 cc/min; the amount of cooling water supplied: 80 liter/min; the temperature of the molten metal in the molten metal receiving port 21 of the spout 15: 650° C.; the number of electromagnetic coil poles: 4 poles; the magnetic flux density of the mold wall: 300 Gs; and the frequency: 50 Hz.

The spout in the apparatus of the comparative example has the inside radius $r_1$ uniform over the entire length thereof, and the inside radius $r_1$ was varied to vary the amount $\Delta r$ of protrusion of the spout 15. The spout 15 is referred to as an equal-diameter bored spout. Other casting conditions are the same as in the items (1) and (2).

Various continuous casting materials M having a diameter of 152 mm were produced under the above-described casting conditions.

Table 2 shows the used spout, the amount $\Delta r$ of protrusion of the spout, and the presence or absence of dendrite in the outer periphery k for examples 1 to 4 of continuous casting materials M.

TABLE 2

| Continuous casting material | Spout used | Amount $\Delta r$ of protrusion of spout (mm) | Presence or absence of dendrite in outer periphery |
|---|---|---|---|
| Example 1 | Different-diameter bored | 2 | Absence |
| Example 2 | Different-diameter bored | 5 | Absence |
| Example 3 | Equal-diameter bored | 20 | Presence |
| Example 4 | Equal-diameter bored | 36 | Presence |

A. Rheologic Property

Figure 6:
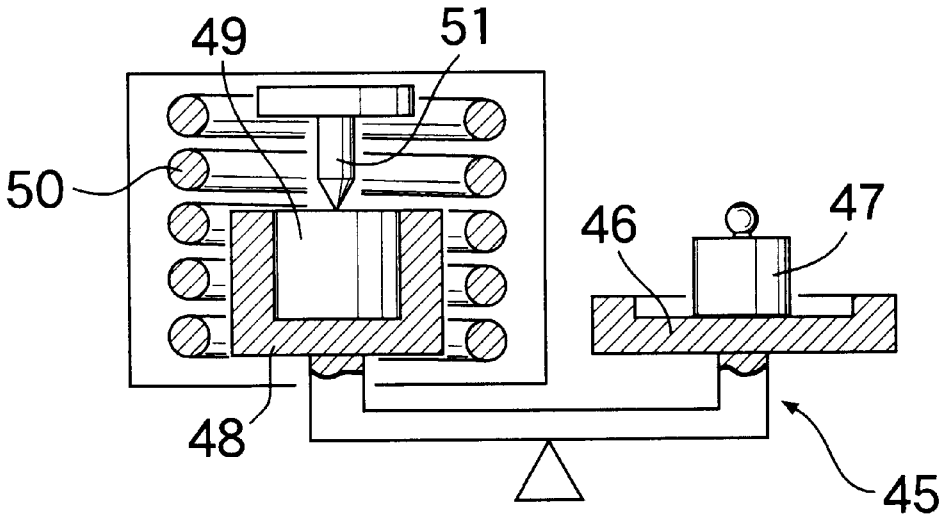
FIG. 6 is a view for explaining a method for measuring a TMA temperature.

A test piece having a diameter of 3 mm and a thickness of 2 mm was cut away from the outer periphery k and a central portion o (see FIG. 5) of each of examples 1 to 4. As shown in FIG. 6, a weight 47 of 20 g was placed onto one dish 46 of a balance 45, and the test piece 49 was fitted into the other container 48 of the balance. Then, the test piece 49 was heated by a heater 50, and a pin 51 having a diameter of 1 mm and a length of 2 mm was urged against the test piece 49, and the temperature at the time when the pin 51 was stuck into the test piece 49 by an urging force balanced with the weight of 20 g, namely, the TMA temperature, was measured. Table 3 shows results of the measurement, and FIG. 7 is a graph taken from Table 3.

TABLE 3

| Continuous casting material | | Example 1 | Example 2 | Example 3 | Example 4 |
|---|---|---|---|---|---|
| TAM temperature (° C.) | Central portion | 591 | 591 | 591 | 591 |
| | Outer periphery | 588 | 591 | 597 | 600 |

Figure 7:
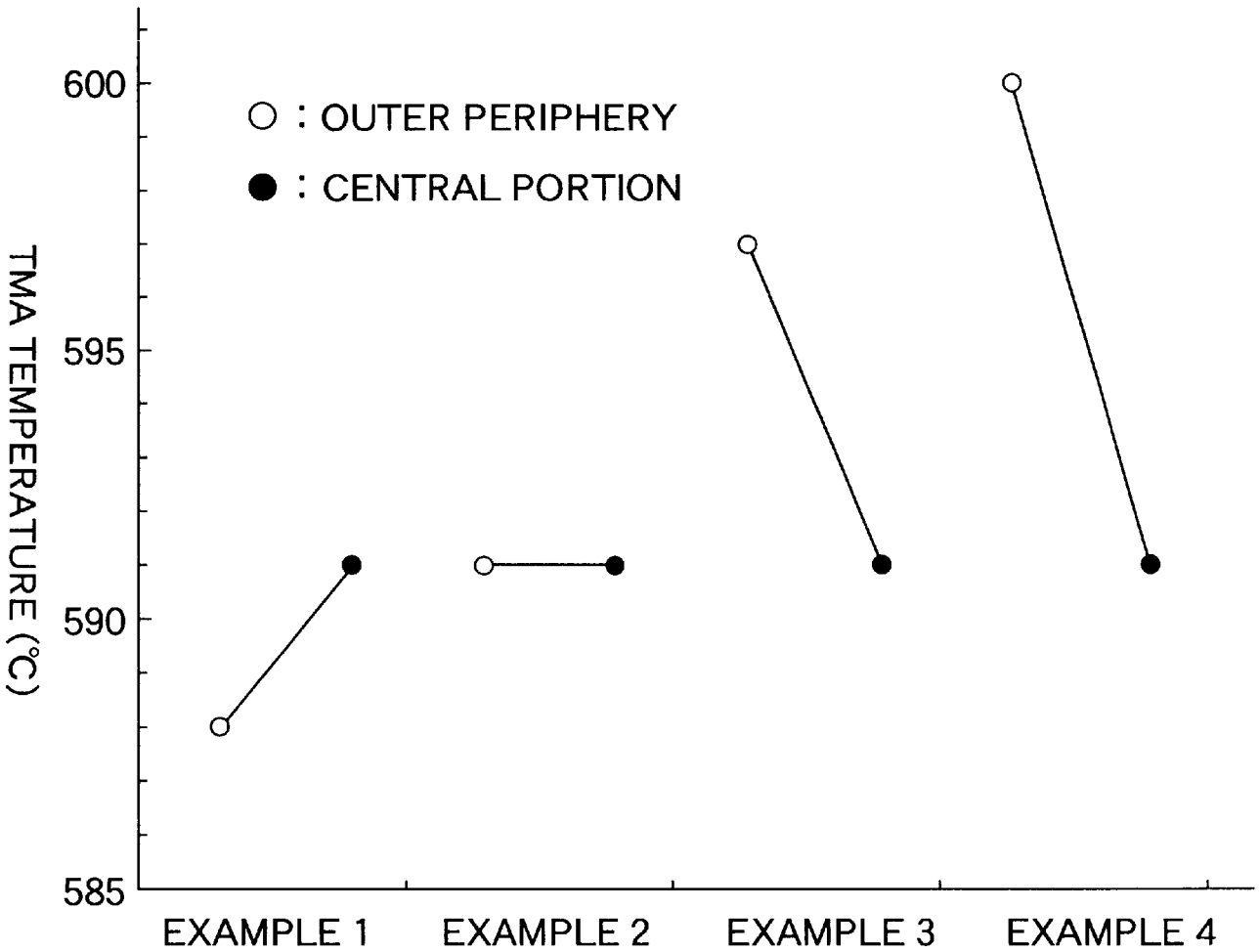
FIG. 7 is a graph showing the TMA temperature for each of examples.

In Table 3 and FIG. 7, the TMA temperature of the central portion o assumes the same value in examples 1 to 4. However, the temperature of the outer periphery k assumes values approximating to or equal to those of the central portion o in the cases of examples 1 and 2, but assumes values substantially higher than those of the central portion o in the cases of examples 3 and 4. This is attributable mainly to the presence or absence of dendrite in the outer periphery k. In examples 1 and 2, it is obvious that the outer periphery k and the central portion o show a similar softening property, and hence, examples 1 and 2 have a good rheologic property.

B. Shape-Maintaining Property

Figure 8:
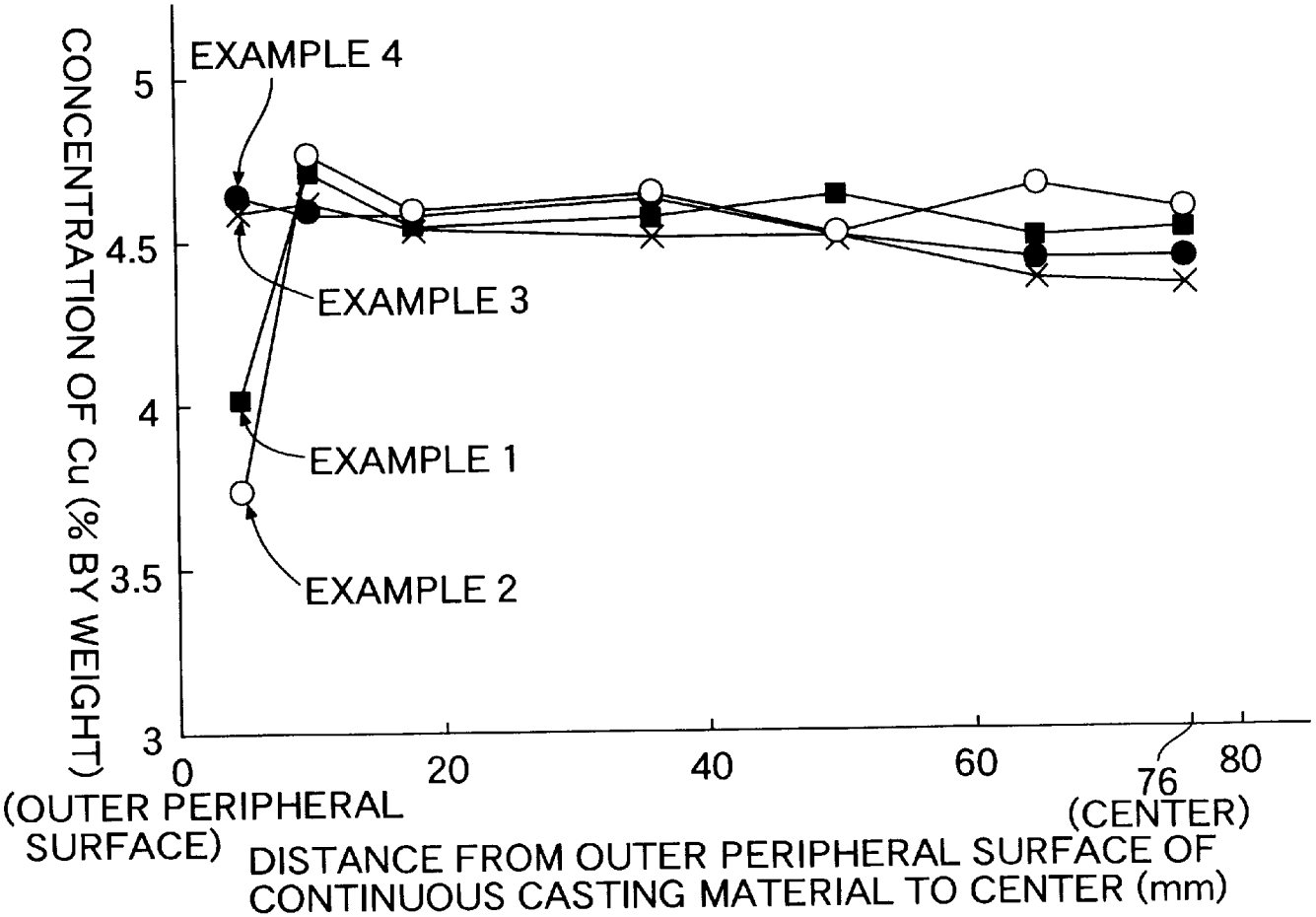
FIG. 8 is a graph showing the relationship between the distance from an outer peripheral surface to the center of the continuous casting material and the concentration of Cu.
Figure 9:
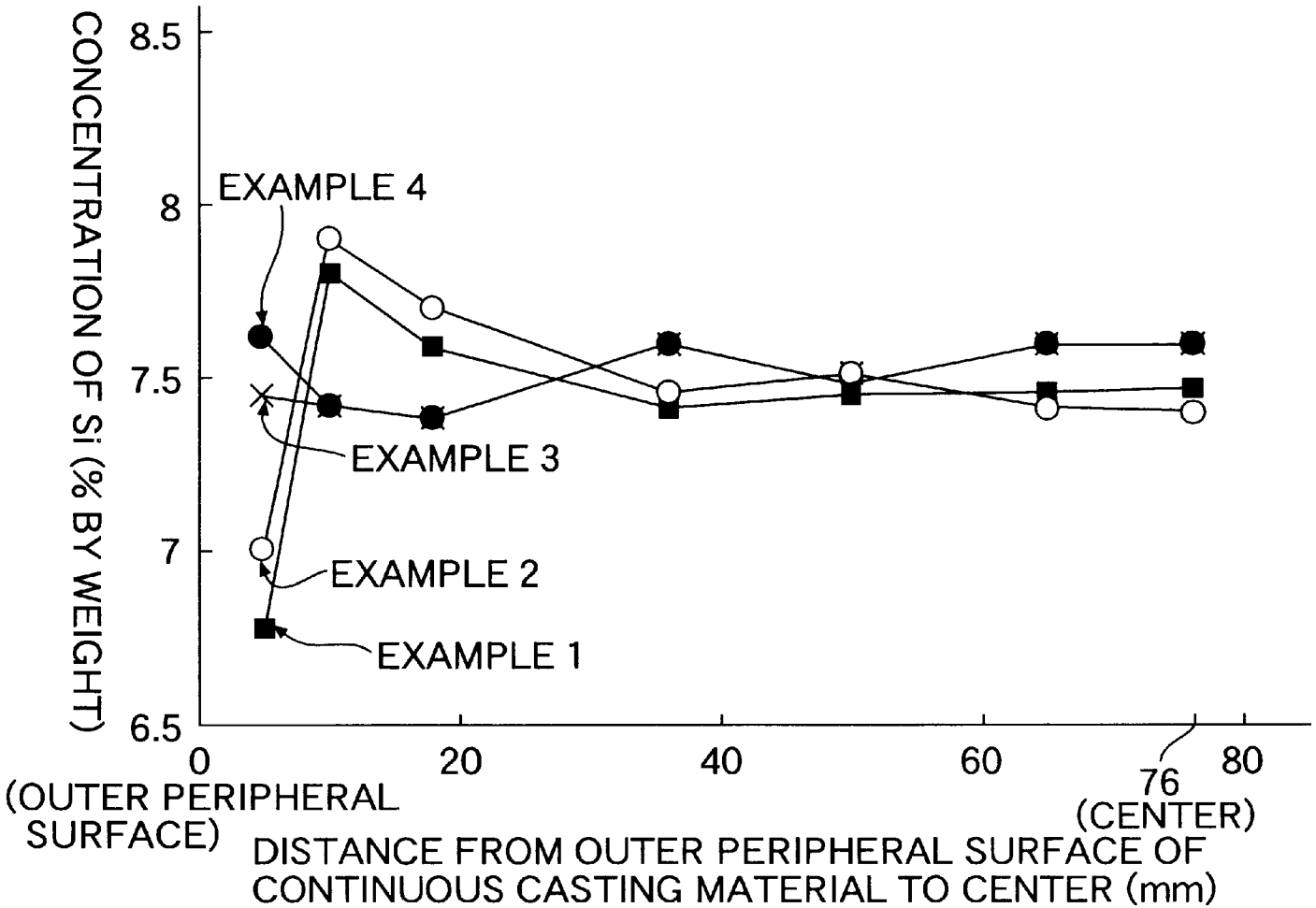
FIG. 9 is a graph showing the relationship between the distance from the outer peripheral surface to the center of the continuous casting material and the concentration of Si.
Figure 10:
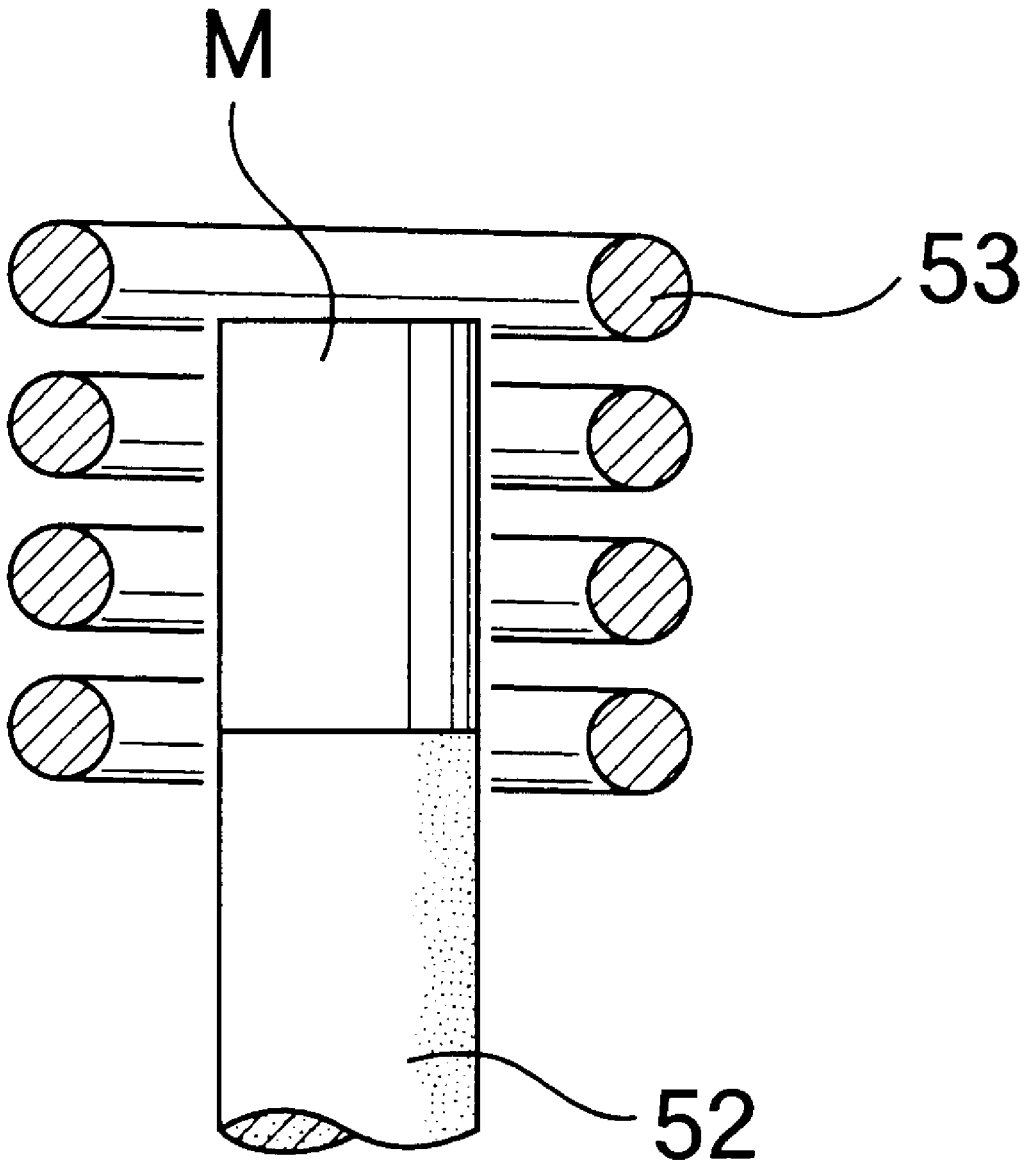
FIG. 10 is a view for explaining a method for measuring the shape maintaining property of the continuous casting material.
Figure 11:
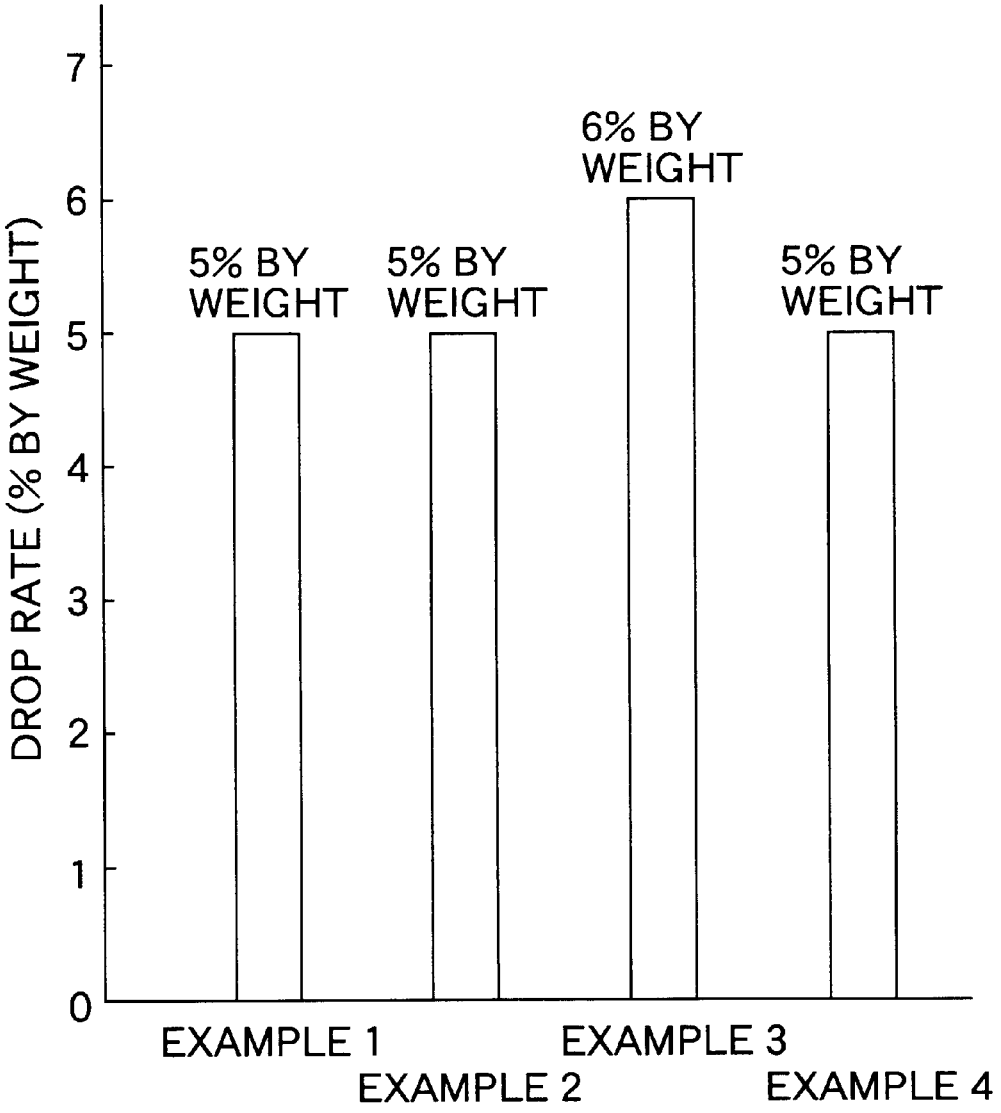
FIG. 11 is a graph showing the drop rate for each of the examples.

The concentrations of Cu and Si in an area from the outer periphery k to the central portion o were examined for examples 1 to 4 to provide results shown in FIGS. 8 and 9. Cu and Si are chemical constituents which drop the melting point of the aluminum alloy. The lower concentrations of Cu and Si in a certain portion mean that a large number of crystallized products of a higher melting point exist in such portion. As apparent from FIGS. 8 and 9, it can be seen that the concentrations of Cu and Si in the outer periphery k in examples 1 and 2 are lower than those in examples 3 and 4.

The continuous casting material M having the diameter of 152 mm and the length of 250 mm in each of examples 1 to 4 was raised on the support member 52 and placed into a high frequency coil 53. Then, the material M was heated until a semi-molten state having a solid phase rate of 50% was achieved, and the drop rate of a liquid phase at that time was determined to provide results shown in FIG. 11. Any of examples 1 to 4 shows a good shape maintaining property. This is attributable to the shape retention effect of the crystallized products c of the higher melting point in the cases of examples 1 and 2, but due to the shape retention effect of the dendrite in the cases of examples 3 and 4.

When the different-diameter bored spout 15 was used, if the amount of protrusion of the spout 15 was set at a value larger than 5 mm, e.g., at 10 mm, the crystallization of dendrite was observed in the outer periphery k of the continuous casting material M. Conditions, excluding the point that the casting rate was set at 150 mm/min, were set to be the same as in example 4, and a continuous casting material M was produced under such conditions. Then, the material M was subjected to a machining treatment, whereby the outer periphery k thereof was removed over a thickness of 12.5 mm. It was made clear that the material M with the dendrite removed therefrom in the above manner has a good rheologic property, but was as higher as 10% by weight in drop rate and poor in shape maintaining property.

[Second Example of Production]

Table 4 shows the composition of an aluminum alloy which is a starting material. The aluminum alloy includes no eutectic component.

TABLE 4

| Chemical constituent (% by weight) | | | | | | |
|---|---|---|---|---|---|---|
| Cu | Si | Mg | Fe | Mn | Ti | Al |
| 4.6 | 0.19 | 0.23 | 0.28 | 0.01 | 0.15 | Balance |

Various continuous casting materials M having a diameter of 152 mm were produced under the same casting conditions in the apparatus 1 of the embodiment as in First Example of Production and under the same casting conditions in the apparatus of comparative example as in First Example of Production.

Table 5 shows the used spout, the amount Δr of protrusion of the spout and the presence or absence of dendrite in the outer periphery k for examples 5 to 8 of the continuous casting materials M.

TABLE 5

| Continuous casting material | Spout used | Amount Δr of protrusion of spout (mm) | Presence or absence of dendrite in outer periphery |
|---|---|---|---|
| Example 5 | Different-diameter bored | 2 | Absence |
| Example 6 | Different-diameter bored | 5 | Absence |
| Example 7 | Equal-diameter bored | 20 | Presence |
| Example 8 | Equal-diameter bored | 36 | Presence |

A. Rheologic Property

A test piece having a diameter of 3 mm and a thickness of 2 mm was cut away from the outer periphery k and a central portion o (see FIG. 5) of each of examples 5 to 8, as in First Example of Production. Then, the TMA temperature of the each of the test pieces was measured in the same manner shown in FIG. 6. Table 6 shows results of the measurement, and FIG. 12 is a graph taken from Table 6.

TABLE 6

| Continuous casting material | | Example 1 | Example 2 | Example 3 | Example 4 |
|---|---|---|---|---|---|
| TAM temperature (° C.) | Central portion | 641 | 640 | 641 | 640 |
| | Outer periphery | 640 | 640 | 647 | 650 |

Figure 12:
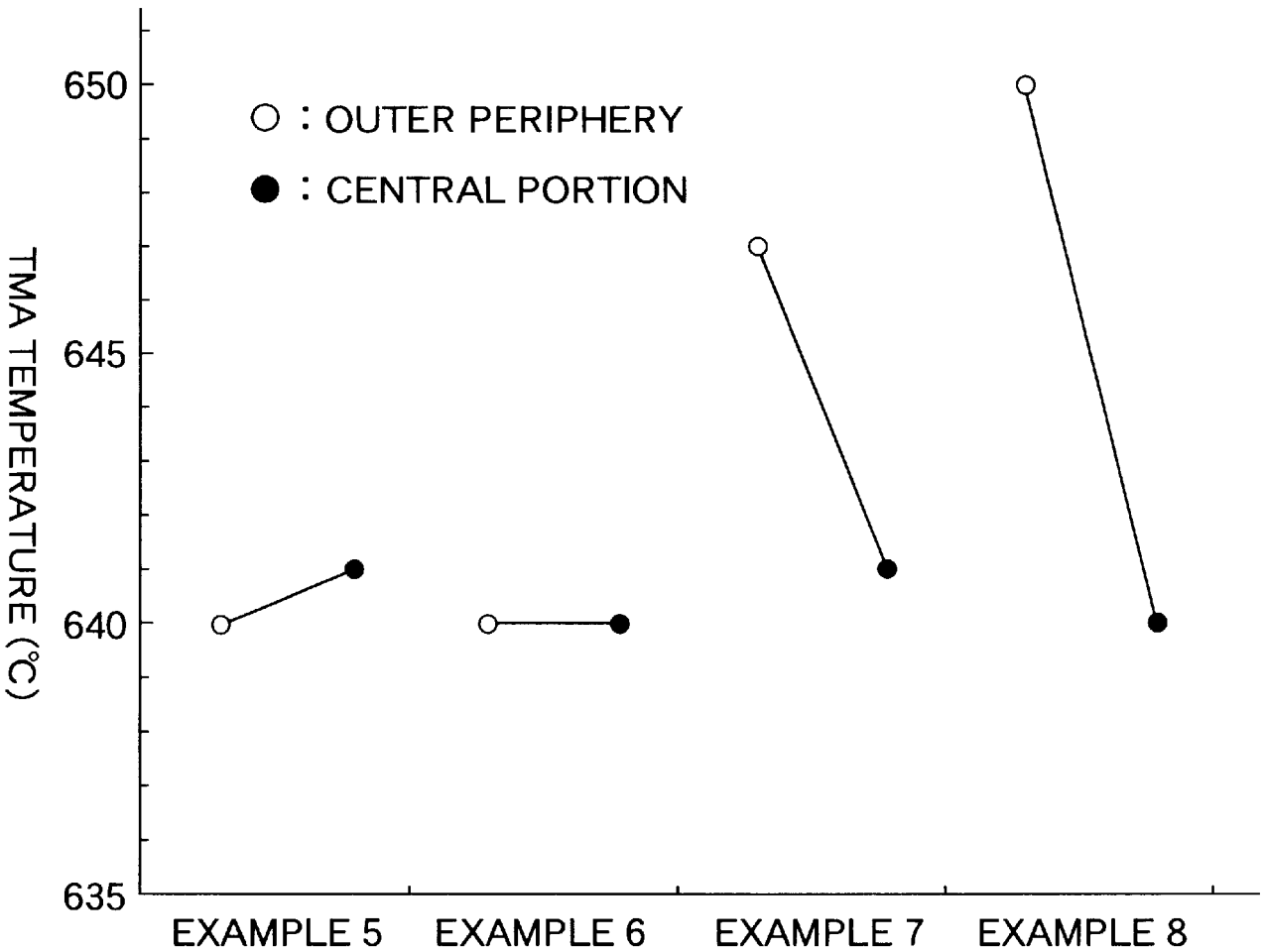
FIG. 12 is a graph showing the TMA temperature for each of the examples.

In Table 6 and FIG. 12, the TMA temperature of the central portion o assumes the same value in examples 5 to 8. However, the temperature of the outer periphery k assumes values approximating to or equal to those of the central portion o in the cases of examples 5 and 6, but assumes values substantially higher than those of the central portion o in the cases of examples 7 and 8. This is attributable mainly to the presence or absence of dendrite in the outer periphery k. In examples 5 and 6, it is obvious that the outer periphery k and the central portion o show a similar softening property, and hence, examples 5 and 6 have a good rheologic property.

B. Shape Maintaining Property

Figure 13:
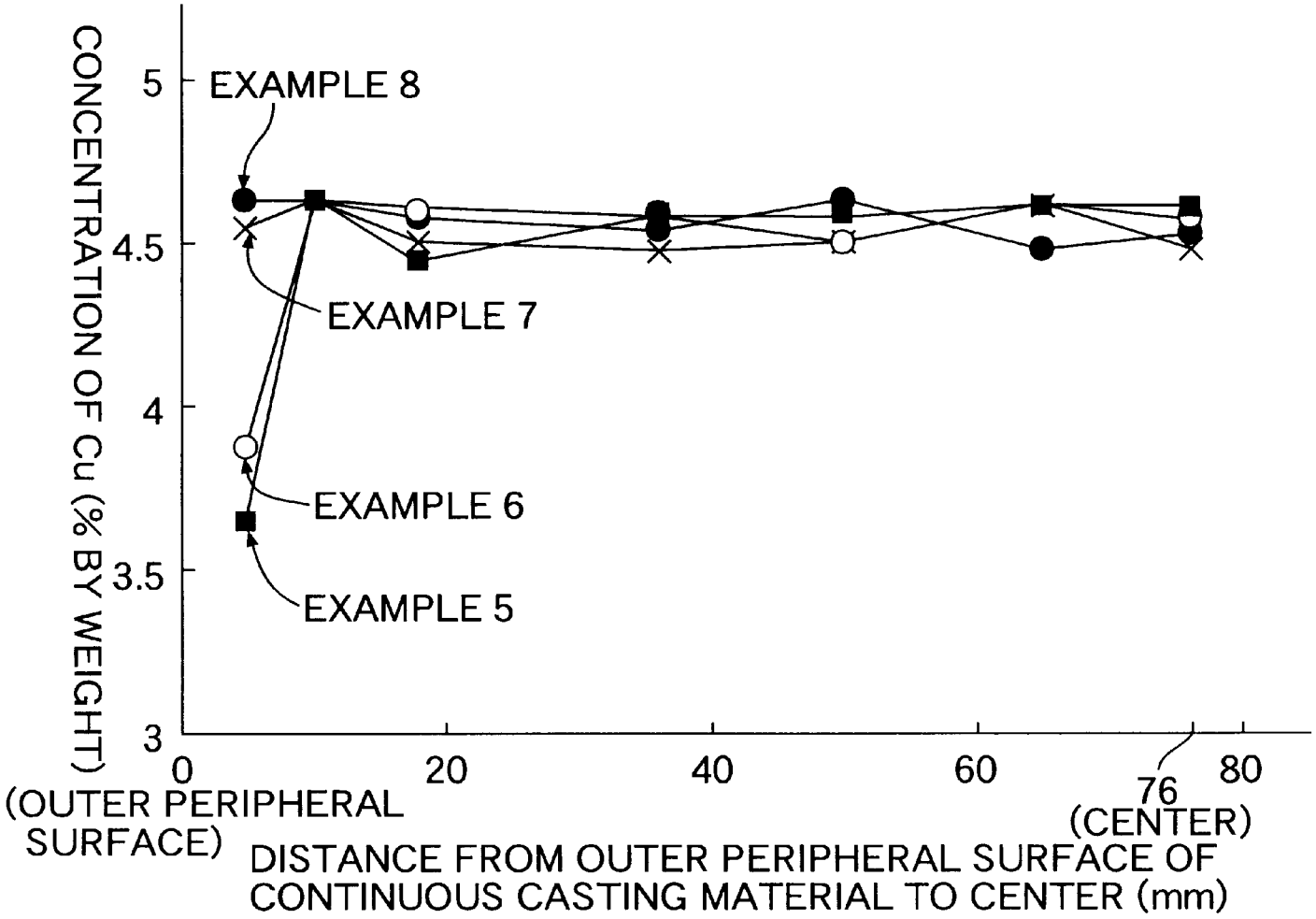
FIG. 13 is a graph showing the relationship between the distance from an outer peripheral surface to the center of the continuous casting material and the concentration of Cu.

The concentration of Cu in an area from the outer periphery k to the central portion o was examined for examples 5 to 8 to provide results shown in FIG. 13. Cu is a chemical constituent which drops the melting point of the aluminum alloy. The lower concentration of Cu in a certain portion means that a large number of crystallized products c of a higher melting point exist in such portion. As apparent from FIG. 13, it can be seen that the concentration of Cu in the outer periphery k in examples 5 and 6 is lower than those in examples 7 and 8.

Figure 14:
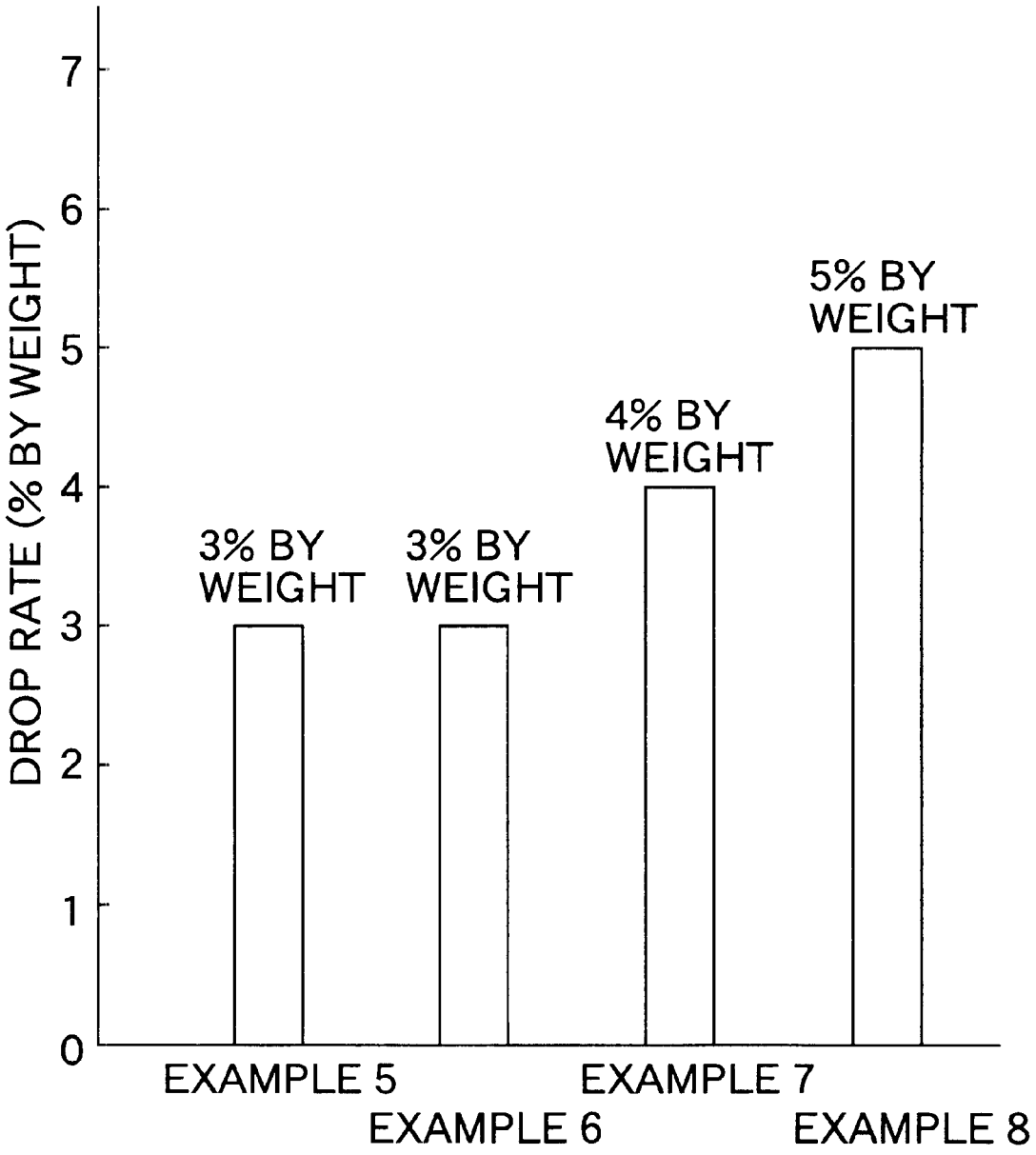
FIG. 14 is a graph showing the drop rate for each of the examples.

The continuous casting material M in each of the examples 5 to 8 was heated until a semi-molten state having a solid phase rate of 50% was achieved, and the drop rate of a liquid phase at that time was determined to provide results shown in FIG. 14. Any of examples 5 to 8 shows a good shape maintaining property. This is attributable to the shape retention effect of the crystallized products c of the higher melting point in the cases of examples 5 and 6, but due to the shape retention effect of the dendrite in the cases of examples 7 and 8.

[Example II (FIGS. 15 to 20)]

Figure 15:
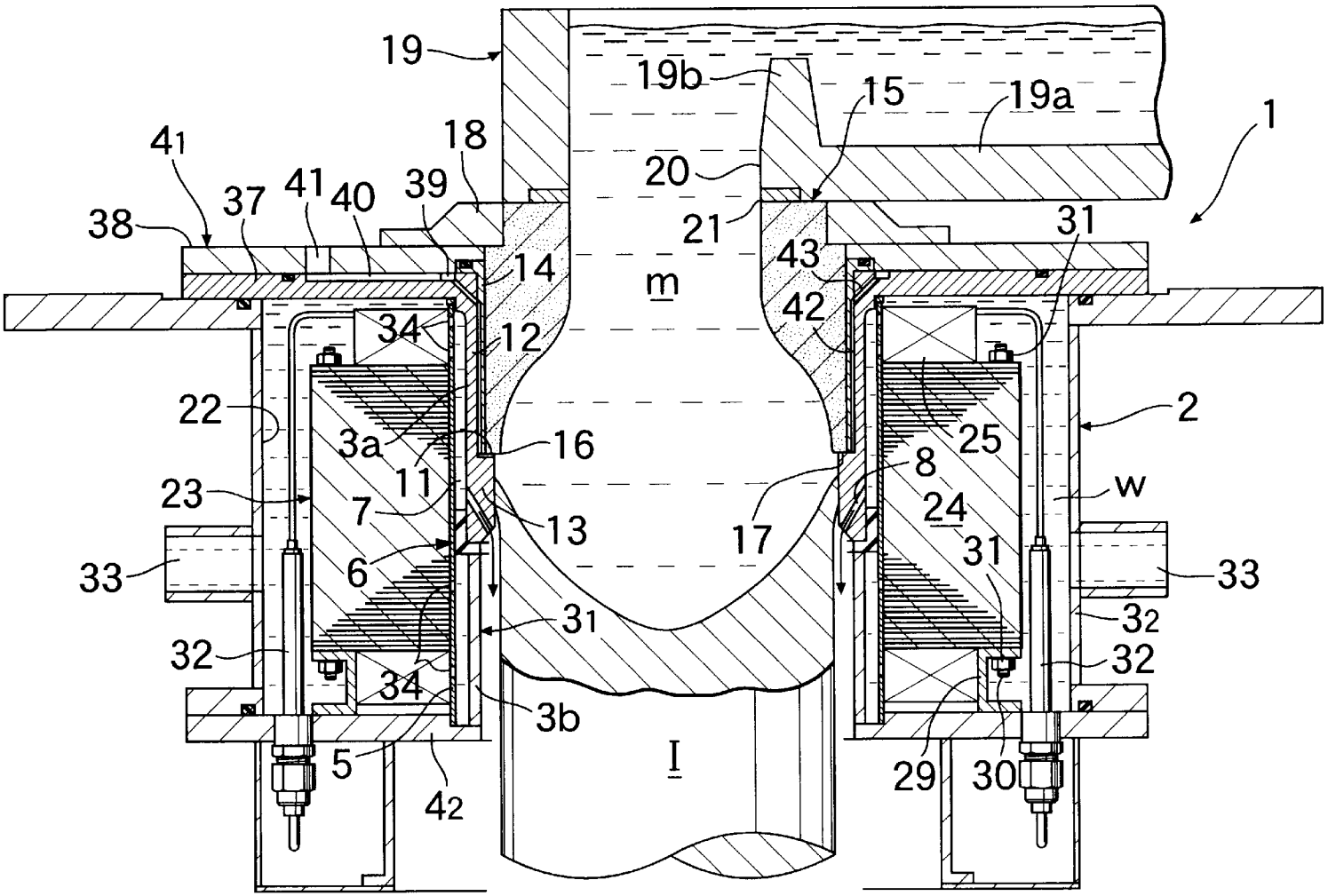
FIG. 15 is a vertical sectional view of an agitated continuous casting apparatus according to another embodiment.

An agitated continuous casting apparatus I shown in FIG. 15 has the substantially same structure as in Example I.

In the molten supply tub 19, a weir 19*b* is provided at the bottom wall 19*a* in the vicinity of the molten metal supply port 20, so that impurities in the molten metal are dammed up by the weir 19*b*.

Figure 16:
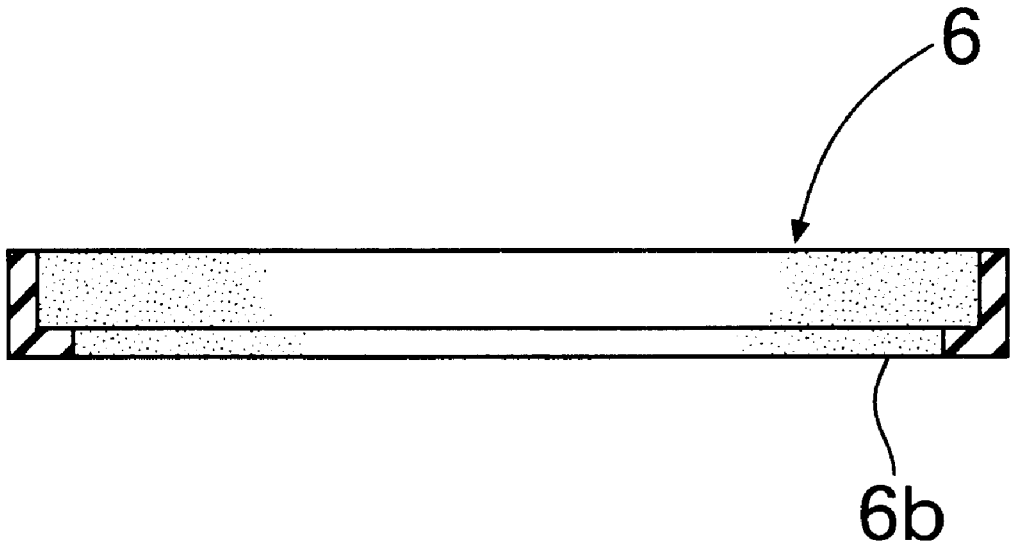
FIG. 16 is a sectional view of a rubber-like elastomeric member.

The rubber-like elastomeric member 6 is best shown in FIG. 16 and has an impact resilience R set in a range of $10\% \leqq R \leqq 40\%$.

During a casting operation, the rubber-like elastomeric member 6 having the impact resilience R set in such range largely suppresses the vibration of the cylindrical water-cooled casting mold 13 due to the electromagnetic agitating force. Thus, the generation of a break-out can be prevented to advance the casting operation smoothly.

If a solidified product has been deposited on the inner surface of the cylindrical water-cooled casting mold 13, the rubber-like elastomeric member 6 permits a partially deformation of the cylindrical water-cooled casting mold 13 in a radially outward direction, based on the impact resilience, when the molten metal m flowing under the action of the electromagnetic agitating force collides against the solidified product. This causes the speed of the cooling water w ejected from the ejection bore 8 by compression of the cooling water sump 7 to be increased, thereby increasing the flow rate. Therefore, the cooling of the ingot I is conducted rapidly and hence, the molten metal in the vicinity of the solidified product is also solidified or brought into a semi-molten state. Therefore, the solidified product is taken into the ingot being dropped and is thus peeled off from the inner surface of the cylindrical water-cooled casting mold 13. In a state in which the solidified product has been deposited on the inner surface of the mold 13, a recessed trace is formed in a direction of a generating line on the outer peripheral surface of the ingot to produce a casting defect.

To determine a range of the impact resiliency R of the rubber-like elastomeric member 6, rubber-like elastomeric members 6 of seven acrylonitrile-butadiene (NBR) rubbers having impact resilience values R of 5%, 10%, 20%, 30%, 40%, 50% and 60% were produced. First, one of the cylindrical elastomeric members 6 was incorporated into the agitated continuous casting apparatus 1 in the same manner as that described above, and a molten metal of an aluminum alloy similar to that shown in Table 1 in Example I was prepared.

Then, the casting operation was carried out under the following conditions to determine the generation rates of the break-out and the recessed trace: the diameter of an ingot was 152 mm; the casting speed was 170 mm/min; a lubricating oil was a PTFE particle-added mineral oil; the amount of lubricating oil supplied was 1 cc/min; the amount of water supplied was 80 liter/min; the temperature of the molten metal in the molten metal receiving port 21 of the spout 15 was 650° C.; an electromagnetic agitating coil was of a submerged 4-pole and 12-coil type; and the agitating frequency was 50 Hz. The similar casting operation was also carried out using the remaining rubber-like elastomeric members to determine the generation rates of the break-out and the like.

Figure 17:
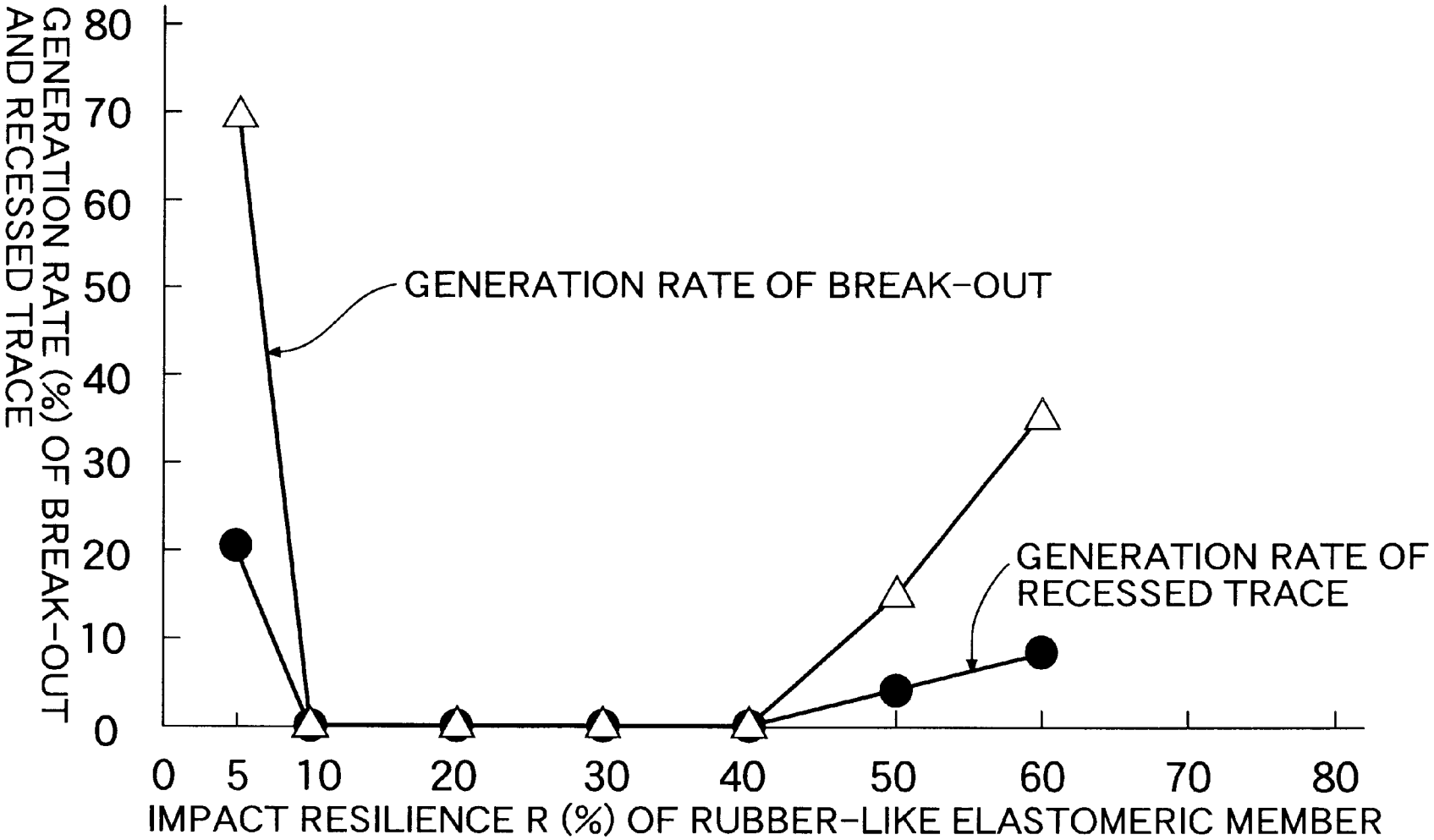
FIG. 17 is a graph showing the relationship between the impact resilience of a rubber-like elastomeric member and the generation rates of a break-out and a recessed trace.

FIG. 17 shows results of the casting. It can be seen from FIG. 17 that if the impact resilience R of the cylindrical elastomeric member 6 is set in a range of $10\% \leqq R \leqq 40\%$, the generation of the break-out and the recessed trace can be avoided.

In addition to the NBR, the materials for forming the rubber-like elastomeric member 6, which may be used, include acrylic rubbers (ACM and ANM) having an impact resilience in a range of $30\% \leqq R \leqq 40\%$, fluorine rubbers (FKM) having an impact resilience in a range of $20\% \leqq R \leqq 40\%$, and the like.

For comparison, the similar casting operation was carried out 50 times using an apparatus (a comparative example 1) including an annular member of a stainless steel (JIS SUS304) interposed between the cylindrical water-cooled casting mold 13 and the cylindrical partition wall 5, and an apparatus (a comparative example 2) including no annular member, namely, no solid interposed between both the members 13 and 5. The frequency of generation of the break-out and the number of recessed traces per the entire number (50—the frequency of generation of the break-out= the number of ingots) of cast ingots having a diameter of 152 mm and a length of 2 mm, were examined to provide results shown in Table 7.

TABLE 7

| | Comparative example 1 | Comparative example 2 |
|---|---|---|
| Frequency of generation of breakout | 5 | 15 |
| Number of recessed traces per entire number of ingots | 20/45 | 94/35 |

It can be seen from Table 7 and FIG. 17 that comparative example 1 corresponds to a case where the impact resilience R of the rubber-like elastomeric member 6 is higher than 40%, and comparative example 2 corresponds to a case where the impact resilience R of the rubber-like elastomeric member 6 is lower than 10%.

Figure 18:
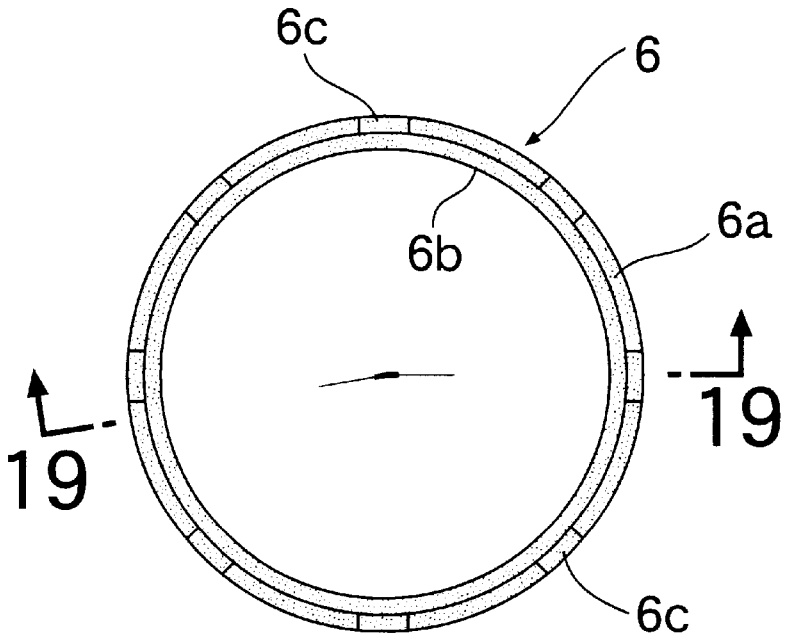
FIG. 18 is a plan view of the rubber-like elastomeric member.
Figure 19:
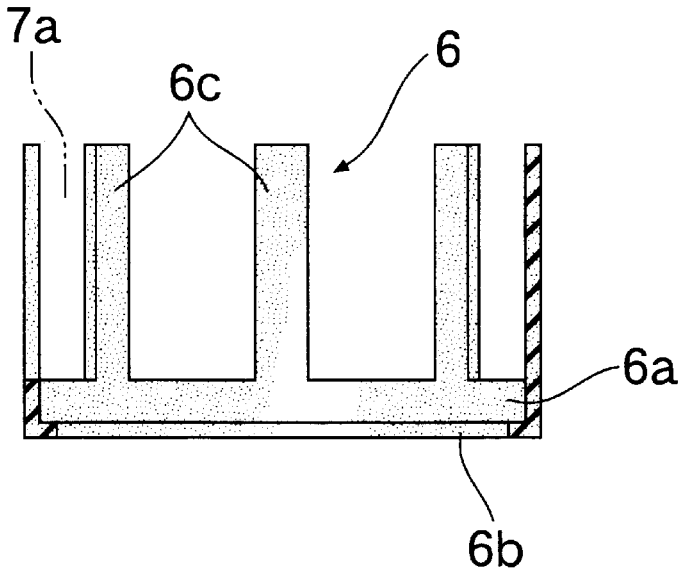
FIG. 19 is a sectional view taken along a line 19—19 in FIG. 18.
Figure 20:
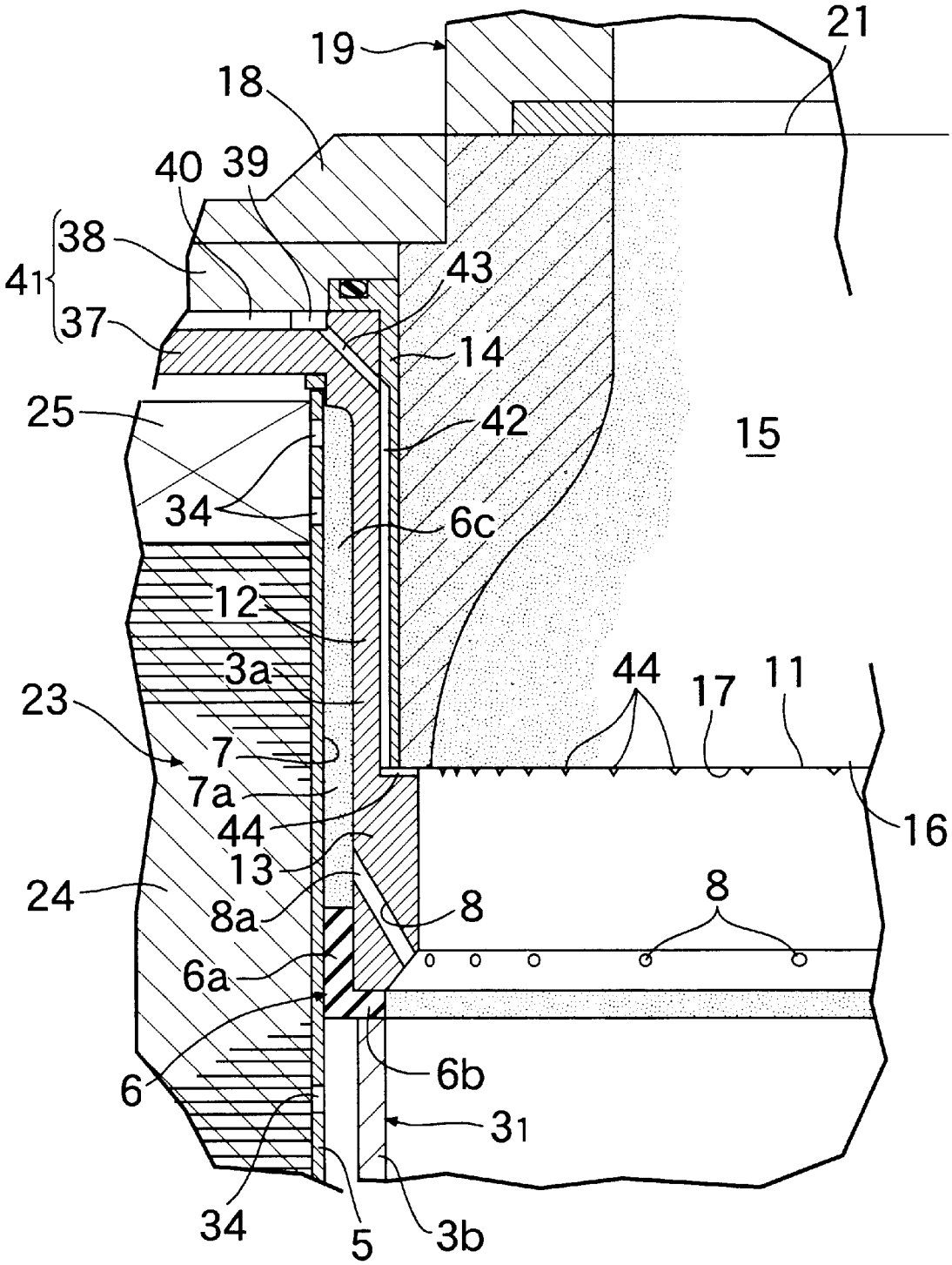
FIG. 20 is an enlarged view similar to FIG. 2, but showing an essential portion of the agitated continuous casting apparatus according to the other embodiment of the present invention.

FIGS. 18 and 19 show another rubber-like elastomeric member 6. The rubber-like elastomeric member 6 includes a main annular portion 6*a* fitted into the cylindrical water-cooled casting mold 13 below the inlet 8*a* of each of the ejection bores 8, a plurality of dividing portions 6*c* extending in the direction of the generating line of the cylindrical water-cooled casting mold 13 from an upper end face of the main annular portion 6*a* for dividing the cooling water sump 7 into a plurality of sections, and an inward-turned annular portion 3*b* provided at a lower end of an inner peripheral surface of the main annular portion 6*a* and clamped between the lower end face of the cylindrical water-cooled casting mold 13 and an upper end face of the lower cylindrical portion 3*b* to seal a section between both the end faces. In this case, each of the dividing portions 6*c* has a length substantially equal to the vertical length of the cooling water sump 7, and the inlet or inlets 8*a* of one or two or more of the ejection bores 8 communicate with a divided portion 7*a* of the cooling water sump 7 between the adjacent dividing portions 6*c*.

If the rubber-like elastomeric member 6 is formed in the above manner, the compression of the cooling water sump 7 resulting from the above-described deformation permitting effect can be produced in the divided portion 7*a* between the adjacent dividing portions 6*c*, thereby further increasing the flow rate of the cooling water from the ejection bores 8.

What is claimed is:

1. An agitated continuous casting apparatus comprising a spout having an upward-turned molten metal receiving port and a downward-turned molten metal outlet, a cylindrical water-cooled casting mold disposed immediately below said spout to cool a molten metal from said molten metal outlet, and an agitator for applying an electromagnetic agitating force to the molten metal in said spout so as to rotate the molten metal in a circumferential direction, wherein said spout has an upper area forming portion for forming a lower area and a lower area forming portion for forming a lower area at an inner peripheral surface thereof, said upper area forming portion being formed into a tapered shape with an inside diameter thereof gradually increasing from its upper peripheral edge toward its lower peripheral edge while said lower area forming portion being formed into a tapered shape with an inside diameter thereof gradually increasing from said lower peripheral edge of said upper area forming portion, which is an upper peripheral edge of said lower area forming portion, toward a lower peripheral edge of said lower area forming portion, said upper and lower area forming portions being continuous curved faces, and a relationship, $R_1<R_2$, being established between a radius $R_1$ of curvature of said upper area forming portion and a radius $R_2$ of curvature of said lower area forming portion, and said agitator cooperates with said upper and lower area forming portions of the spout to form, in said spout, said upper area for permitting the molten metal to move in a substantially radiate direction while permitting the molten metal to rotate in said circumferential direction, and said lower area for permitting the molten metal to rotate in the circumferential direction, so that the molten metal of said upper area that is in the substantially radiate direction and collided against said upper area forming portion at the inner peripheral surface of said spout is moved toward said lower area; wherein back flow of crystallized products from the lower area to the upper area is not produced and wherein outlets for lubricating oil are provided around a lower end of said spout so as to be open into said casting mold.

2. An agitated continuous casting apparatus according to claim 1, wherein said molten metal outlet is said lower peripheral edge of said lower area forming portion.

3. An agitated continuous casting apparatus according to claim 1 or 2, wherein relationships, $r_1<r_2$ and $r_2-r_1=\Delta r$ (wherein $\Delta r$ is an amount of protrusion of said spout) are established between an inside radius $r_1$ of said molten metal outlet of said spout and an inside radius $r_2$ of said water-cooled casting mold, said amount of protrusion $\Delta r$ of said spout being the maximum value of a distance that is required for avoiding crystallization of dendrite, when the molten metal from said molten metal outlet is brought into contact with an inner peripheral surface of said water-cooled casting mold.

4. An agitated continuous casting apparatus according to claim 1, wherein said agitator is located so as to surround said upper and lower area forming portions of the spout from a radially outside.

5. An agitated continuous casting apparatus comprising a cylindrical water-cooled casting mold having a vertically turned axis and a plurality of cooling water ejecting bores provided through a lower portion of a peripheral wall of said casting mold, a cylindrical partition wall surrounding the casting mold to define a cooling water sump around an outer periphery of said cylindrical water-cooled casting mold, and an agitator for applying an agitating force to a molten metal in said cylindrical water-cooled casting mold for causing the molten metal (m) to flow in a circumferential direction, wherein a rubber-like elastomeric member having an impact resilience R in a range of $10\% \leqq R \leqq 40\%$ is interposed between said cylindrical water-cooled casting mold and said cylindrical partition wall.

6. An agitated continuous casting apparatus according to claim 5, wherein said rubber-like elastomeric member is an annular member which is fitted into said cylindrical water-cooled casting mold at a position below an inlet of each of said ejection bores.

7. An agitated continuous casting apparatus according to claim 5, wherein said rubber-like elastomeric member includes a main annular portion which is fitted into said cylindrical water-cooled casting mold at a position below an inlet of each of said ejection bores, and a plurality of dividing portions extending from said main annular portion along a generatrix of the cylindrical water-cooled casting mold to divide said cooling water sump into a plurality of sections.

* * * * *